US005269062A

United States Patent [19]

Dallaire et al.

[11] Patent Number: 5,269,062

[45] Date of Patent: Dec. 14, 1993

[54] FOLDING RAZOR WITH A FOAM DISPENSER

[75] Inventors: Michel Dallaire; Michel Swift; Michael Santella, all of Quebec, Canada

[73] Assignee: Robert Marcotte, St. Augustin, Canada

[21] Appl. No.: 881,875

[22] Filed: May 12, 1992

[51] Int. Cl.[5] ..... B26B 21/44

[52] U.S. Cl. ..... 30/41; 30/86

[58] Field of Search ..... 30/41, 47, 57, 84, 86, 30/125

[56] References Cited

U.S. PATENT DOCUMENTS

| | | | |
|---|---|---|---|
| 1,357,679 | 11/1920 | Ball | 30/86 |
| 2,818,872 | 1/1958 | Wang | 30/86 |
| 3,349,484 | 10/1931 | Zeles | 30/86 |
| 3,703,765 | 11/1928 | Perez | 30/41 |
| 4,074,428 | 2/1978 | Roberts | 30/41 |
| 4,377,034 | 3/1983 | Druash et al. | 30/41 |
| 4,433,483 | 2/1984 | Lazarus | 30/41 |
| 4,635,361 | 1/1987 | De Mars | 30/41 |
| 4,791,723 | 12/1988 | Jacobson | 30/41 |
| 4,813,138 | 3/1989 | Chen | 30/86 |
| 4,841,635 | 6/1989 | Maurizi et al. | 30/86 |
| 4,908,945 | 3/1990 | Jacobson | 30/86 |
| 4,977,669 | 12/1990 | Clifford | 30/41 |
| 5,016,351 | 3/1991 | Drahus | 30/41 |

*Primary Examiner*—Douglas D. Watts
*Assistant Examiner*—Hwei-Siu Payer
*Attorney, Agent, or Firm*—Jacobson, Price, Holman & Stern

[57] ABSTRACT

The present invention relates to a folding razor provided for carrying as a ball-point pen when packaged. The razor head is pivoted in a folded position which is compact enough to be enclosed in a cylindrical cap. The shaving lather is contained within a lather dispenser which serves as the handle portion of the razor and which is provided with a lather discharge nozzle and a button valve actuator. The razor provides for a ready-to-use shaving lather while in a shaving position.

9 Claims, 2 Drawing Sheets

FOLDING RAZOR WITH A FOAM DISPENSER

BACKGROUND OF THE INVENTION (a) Field of the Invention

The invention relates to a shaving razor, and more particularly to a compact folding razor with a pivotable razor head and a lather container forming a handle and being provided with an actuated discharge nozzle.

(b) Description of Prior Art

Shaving kits are generally made up of a number of several components namely a razor, a package of blades, a lather forming material such as a solid soap or a pressurized foam dispenser. When travelling the shaving gear must be collected and stored in a kit bag or the like which is then added to the suitcase. These various components collectively are rather bulky and for short trips they occupy a relatively large amount of space in the baggage and cannot be easily accommodated in an overnight bag or briefcase.

U.S. Pat. No. 3,703,765 issued on Nov. 28, 1972 discloses a disposable razor which includes a blade secured therein and a supply of shaving cream in the handle thereof to be manually dispensed by a telescoping movement of the handle over the central stem of the razor. This disposable razor is provided with a bore through the stem over which the handle manually telescopes for dispensing desired amount of shaving cream to a an aperture in the head of the razor. The aperture in the head of the razor is provided with a pressure sensitive adhesive coated paper tab for contact with the surface of the head around the aperture for sealing the dispensing aperture prior to usage of the razor. This razor is disposed after one use and must be contained within a housing for safety.

U.S Pat. No. 3,349,484 issued on Oct. 31, 1967 discloses a folding safety razor which is provided with a handle portion which carries a soap dispenser, a folding razor head and a removable cap. The cap is provided with a blade dispenser serving also as a clip for attaching the device to a shirt pocket or the like. The folding safety razor with the self-contained lather dispenser are housed in a small compact casing that is easily carried on the person as in a pocket in the same manner as a pen or a pencil. Although this shaving kit is safely compacted, foam dispenser must be taken out of the housing for usage and does not provide a ready-to-use shaving cream.

SUMMARY OF THE INVENTION

One aim of the present invention is to provide for a compact folding razor which can be carried about in a pocket.

Another aim of the present invention is to provide for a compact razor wherein a lather container is part of the structure of the razor and serves as a handle.

Another aim of the present invention is to provide for a compact razor which has a ready-to-use lather container for easy and rapid dispensing of shaving lather while shaving.

A further aim of the present invention is to provide for a compact razor wherein the lather container provides for a supply of shaving lather for more than one shaving and the lather container can be discarded when empty and replaced by a refill lather container.

In accordance with the present invention there is provided a folding razor comprising:

a body having a tubular member having first and second opposite ends and an elongated member extending from the first end and defining a longitudinal axis;

a movable head pivotally mounted onto the elongated member, wherein the head is pivotable from a folded position substantially parallel to the longitudinal axis of the elongated member to a shaving position perpendicular to the longitudinal axis;

head locking means for locking the head in a shaving position;

a shaving blade;

blade mounting means for mounting the blade to the movable head;

a first opening formed in the body in proximity to the first end of the tubular member;

a lather containing means including a lather container and having a lather discharging means at one end of the container, the container forming a handle and including an exterior wall portion adapted to be received in the tubular member from the second end wherein the discharging means extends within the body in communication with the first opening; and actuating means for dispensing the lather through the first opening.

BRIEF DESCRIPTION OF THE DRAWINGS

Having thus generally described the nature of the invention, reference will now be made to the accompanying drawings, showing by way of illustration a preferred embodiment thereof, and wherein.

DETAILED DESCRIPTION OF THE INVENTION

Figure 4:
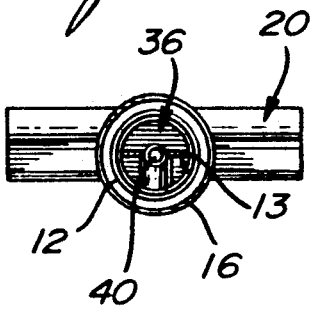
FIG. 4 is a bottom plan view of the folding razor shown without the lather container.

With reference to the drawings, it will be seen that the folding razor 10 according to one embodiment of the invention is organized about a tubular member 12 having a first end 14 and an opposite end 16. A stem 18 extends from the first end 14 of the circular cylindrical tubular member 12. The tubular member 12 defines a bore 13 as shown in FIG. 4. The stem 18 defines a longitudinal axis of the razor 10.

Figure 1:
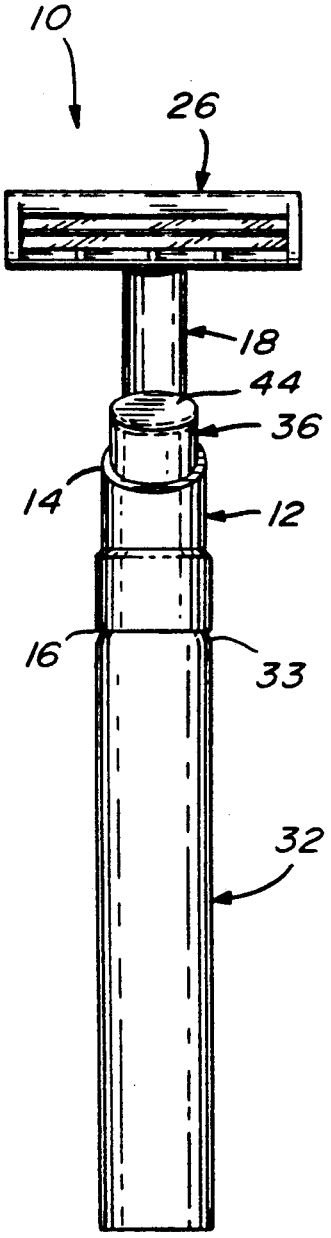
FIG. 1 is a front elevation of an embodiment of the folding razor of the present invention in a shaving position.
Figure 2:
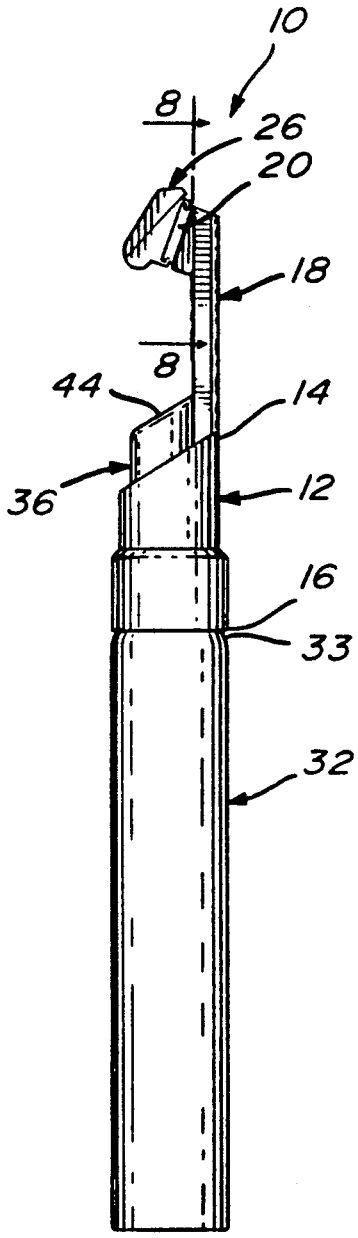
FIG. 2 is a side elevation thereof.
Figure 8:
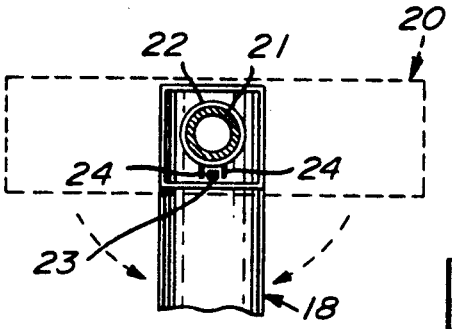
FIG. 8 is a fragmentary vertical cross section taken along line 8—8 of FIG. 2.
Figure 9:
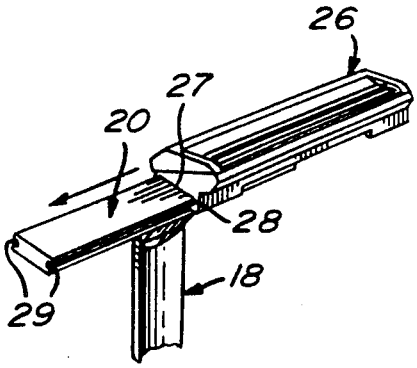
FIG. 9 is a fragmentary perspective view of the head portion of the razor.
Figure 5:
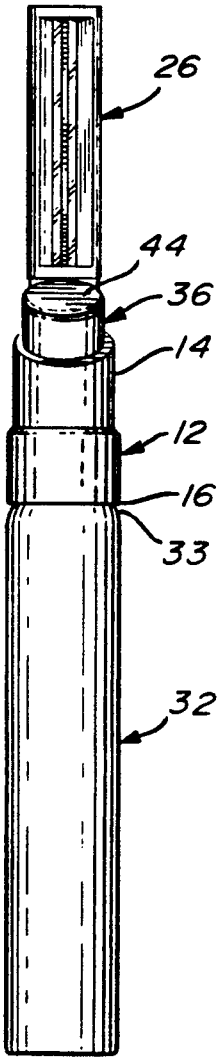
FIG. 5 is a front elevation of the razor in a folded position.
Figure 7:
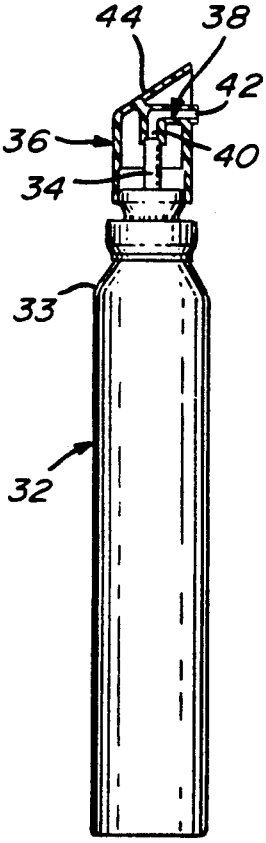
FIG. 7 is a longitudinal cross-sectional view of the razor shown in FIG. 1.

A movable razor head 20 is pivotally mounted onto the stem 18 by means of interlocking circular male rib 21 on head 20 and corresponding female groove 22 on the stem 18. The movable head 20 can be pivoted from a folded position as shown in FIG. 5 where the razor head 20 is substantially parallel to the longitudinal axis of the stem 18 to a shaving position as shown in FIG. 1 where the razor head 20 is perpendicular to the longitudinal axis of the stem 18. The razor head 20 is provided with head locking means which includes a protrusion 23 adapted to snap in between corresponding ribs 24 as shown in FIG. 8. The movable head 20 comprises a shaving blade portion 26 defining at its base a slot 27 having a cross-sectional T-shape as shown in FIG. 9. The T-shaped slot 27 defining extremities 28 which are adapted to engage corresponding depressions 29 of the movable head 20 as shown in FIG. 9. The shaving blade portion 26 of the razor head 20 can be removed from the razor head 20 by a sliding movement along the longitudinal axis of the razor head 20 so that the extremities 28 can disengaged the corresponding depressions 29. The shaving blade portion 26 can be replaced once it is worn-out.

Figure 3:
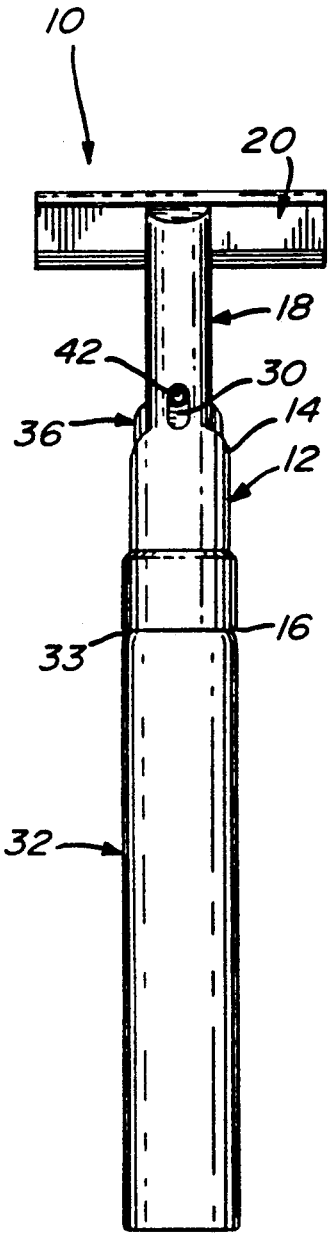
FIG. 3 is a rear elevation thereof.

A first opening 30 is formed in the tubular member 12 in proximity to the first end 14. Preferably the opening is located on the rear side of the tubular member 12 as shown in FIG. 3. The opening 30 is preferably of oblong shape with the elongated axis parallel with the longitudinal axis of the stem 18.

A lather container dispenser 32 forms a handle and includes an exterior wall portion 33 adapted to engage in a tight fit within the bore 13 through the second end 16 of the tubular member 12. The lather container dispenser 32 includes a lather discharge nozzle 34. The tubular member 12 is further provided with a button actuated valve 36 which includes a lather conduit 38 having a second opening 40 and a third opening 42 and a button actuator 44. The third opening 42 is aligned with the oblong opening 30 of the tubular member 12. When the exterior wall portion 33 of the lather container dispenser 32 is engaged in a tight fit within the tubular member 12 at the second end 16, the discharge nozzle 34 is in communication with the button actuated valve 36, first opening 40 of the lather conduit 38. Upon pressing on the button 44, the button actuator valve 36 is lowered to depress the discharge nozzle 34 whereby shaving lather is caused to be expelled from the lather container dispenser 32 into the lather conduit 38 to exit through the third opening 42. The lather container dispenser 32 can be removed when the supply of lather is depleted and then replaced by a new lather container dispenser 32.

Figure 6:
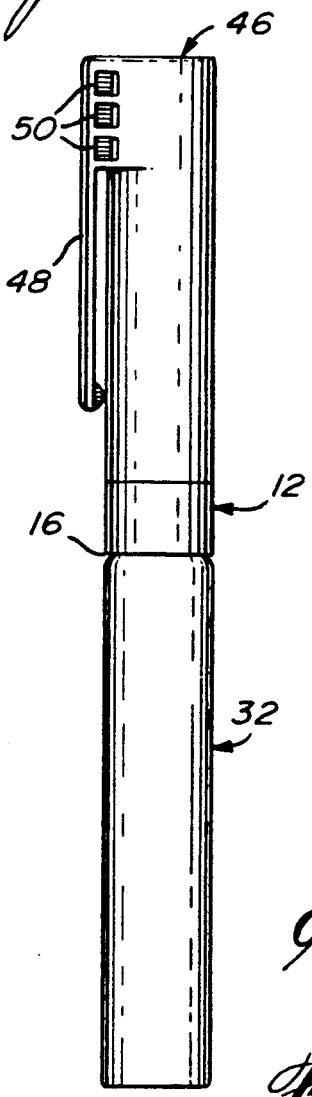
FIG. 6 is a side elevation of the razor of the present invention in a closed assembly.

A tubular cap 46, preferably circular, is provided and is adapted to engage the first end 14 of the tubular member 12 to telescopically enclose the movable head 20 when in a folded position as shown in FIG. 6. The cap 46 is also provided with a pocket clip 48 to carry the folding razor 10 in a pocket.

Openings 50 may be provided on the tubular cap 46, as shown in FIG. 6. This will allow the interior of the cap to be ventilated and thus drying of the used shaving blade 26 for hygienic and practical purposes. Such a breathable cap 46 with the openings 50 also allows for emergency respiration if ever the cap 46 is being swallowed by a child for instance.

While the invention has been described with particular reference to the illustrated embodiment, it will be understood that numerous modifications thereto will appear to those skilled in the art. Accordingly, the above description and accompanying drawings should be taken as illustrative of the invention and not in a limiting sense.

The embodiments of the invention in which an exclusive property or privilege is claimed, are defined as follows:

1. A folding razor comprising:

a body having a tubular member having first and second opposite ends and an elongated member extending from said first end and defining a longitudinal axis;

a movable head pivotally mounted at a free end of said elongated member, said head being pivotable from a folded position aligned substantially parallel to said longitudinal axis and extending beyond said free end of said elongated member to a shaving position extending perpendicular to said longitudinal axis;

head locking means for locking said head in a shaving position, said head locking means including means defined by said head and said elongated member for locking said head in a single position with respect to said elongated member so that said movable head is positioned for shaving of an individual upon movement of said head in a direction towards said body whereby a force is required to overcome a locking force exerted by said means between said head and said elongated member so as to reposition said head away from said single position and into a position aligned substantially parallel to said longitudinal axis, said means including a protrusion on one of said head and said elongated member and two projections on the other of said head and said elongated member for locking said head and said elongated member by snapping of said protrusion in between said two projections;

a shaving blade;

blade mounting means for mounting said blade to said movable head;

a first opening formed in said body in proximity to said first end of said tubular member diametrically opposed relative to said movable head;

a lather containing means for storing shaving lather including a lather container having a lather discharging means at one end of said container for discharging lather, said container forming a handle and including an exterior wall portion adapted to be received at said tubular member from the second end wherein said discharging means extends within said body in communication with said first opening; and actuating means disposed on said container adjacent said first end of said tubular member for dispensing said lather through said first opening.

2. The folding razor of claim 1, which further comprises a tubular cap adapted to engage said first end of said tubular member to telescopically enclose said head when in a folded position.

3. The folding razor of claim 2, wherein said tubular cap comprises at least one opening to allow for ventilation through said cap.

4. The folding razor of claim 1, wherein said lather container is a pressurized lather dispenser and said discharging means is a discharge nozzle.

5. The folding razor of claim 4, wherein said actuating means is a button actuated valve having a lather conduit having a second opening adapted to receive said discharge nozzle and a third opening adapted to be aligned with said first opening, said valve having a button actuator provided onto said tubular member in proximity to said elongated member, whereby upon pressing on said button, lather is expelled from said discharge nozzle into said lather conduit to said first opening.

6. The folding razor of claim 1, wherein said tubular member and said exterior wall of said lather container are of cylindrical configuration.

7. The folding razor of claim 6, wherein said tubular member and said exterior wall of said lather container are engaged in a tight fit.

8. The folding razor of claim 7, wherein said lather container is a cylindrical pressurized lather dispenser and said discharging means is a discharge nozzle formed at one end of said dispenser, wherein the cylindrical portion of said dispenser adjacent to said nozzle is securely engaged into a corresponding cylindrical portion of said member second end of slightly greater diameter than the dispenser diameter, whereby said dispenser is removably secured within said tubular member and can be replaced.

9. The folding razor of claim 1, wherein said elongated member is of a semi-cylindrical configuration extending from said tubular member.

* * * * *